US008025584B2

(12) United States Patent
Foley

(10) Patent No.: US 8,025,584 B2
(45) Date of Patent: Sep. 27, 2011

(54) GOLF BALL EJECTOR FOR GOLF CUPS

(76) Inventor: Keith Foley, Plantation, FL (US)

( * ) Notice: Subject to any disclaimer, the term of this patent is extended or adjusted under 35 U.S.C. 154(b) by 0 days.

(21) Appl. No.: 12/685,456

(22) Filed: Jan. 11, 2010

(65) Prior Publication Data

US 2010/0178995 A1 Jul. 15, 2010

Related U.S. Application Data

(60) Provisional application No. 61/143,952, filed on Jan. 12, 2009.

(51) Int. Cl.
*A63B 57/00* (2006.01)

(52) U.S. Cl. ..... 473/178

(58) Field of Classification Search ..... 473/153, 473/154, 163, 173–180, 182, 183, 190–192, 473/194

See application file for complete search history.

(56) References Cited

U.S. PATENT DOCUMENTS

| | | | | |
|---|---|---|---|---|
| 1,723,547 | A * | 8/1929 | Hassall | 473/177 |
| 1,776,161 | A * | 9/1930 | Lockwood | 473/177 |
| 1,914,994 | A | 6/1933 | Greenwald | |
| 3,310,311 | A | 3/1967 | Peeples | |
| 3,310,312 | A | 3/1967 | Peeples | |
| 3,623,732 | A | 11/1971 | Peeples | |
| 3,792,861 | A | 2/1974 | Coleman | |
| 3,874,665 | A | 4/1975 | McCulloch | |
| 3,897,059 | A | 7/1975 | McCulloch et al. | |
| 4,290,603 | A | 9/1981 | Barnes | |
| 4,496,150 | A | 1/1985 | McGlew | |
| 4,552,358 | A | 11/1985 | McGlew | |
| 4,563,009 | A * | 1/1986 | Nagasaki et al. | 473/183 |
| 5,018,730 | A * | 5/1991 | Iliuta | 473/175 |
| 5,674,131 | A | 10/1997 | Forbes | |
| 5,890,967 | A | 4/1999 | Allen | |
| 6,193,613 | B1 * | 2/2001 | Alexandres | 473/183 |
| 6,409,609 | B1 | 6/2002 | Brezic | |

* cited by examiner

*Primary Examiner* — Mark S Graham
(74) *Attorney, Agent, or Firm* — McHale & Slavin, P.A.

(57) ABSTRACT

Disclosed is a golf ball ejector device for placement within a conventional practice green putting golf cup. The device includes a cylindrical housing constructed and adapted to fit within a conventional golf cup employing a catapult ejector arm recessed into an angular top surface made operational by an actuating switch which is coupled to a drive motor for operation of a timing cam and release of a spring for operation of the catapult ejector arm. The device allows horizontal ejecting of a golf ball when placed beneath the rim of a golf cup.

20 Claims, 6 Drawing Sheets

GOLF BALL EJECTOR FOR GOLF CUPS

CROSS-REFERENCE TO RELATED APPLICATIONS

This application is based upon, and claims the priority date of, U.S. Provisional Patent Application 61/143,952 filed Jan. 12, 2009, the contents of which are incorporated herein by reference.

FIELD OF THE INVENTION

This invention is directed to the field of golf and more particularly to an ejector device that fits within a golf cup for use in ejecting a golf ball out of the golf cup in a horizontal direction.

BACKGROUND OF THE INVENTION

The game of golf is an activity that requires a level of skill in order to compete competitively or enjoy recreationally. The requirements are fairly simple, strike a golf ball as few times as possible to advance the ball from a tee box to a putting green golf ball cup. While the requirements are simple, the game challenges the golfer's ability in a multitude of instances. The ability to advance the ball a long distance requires strength and flexibility. However, the ability to place the ball in the cup once the ball is on the green requires precise alignment and swing speed. Unique to the game of golf is that a stroke is charged against the player whether a ball is advanced 350 yards or 1 inch. For this reason, the "art" of putting is one of the most critical aspects of the game.

For instance, on a par 4 hole a golfer advances the ball down the fairway with hopes of placing the ball on the green using no more than two strokes. In the preferred example, the golfer will place the golf ball on the green using only two strokes wherein the golfer may obtain a birdie (one under par or in this case three strokes) if they are able to place the ball in the hole with one more stroke. If the golfer takes two stokes, also referred to as putting, wherein the golfer would have obtained a par on the hole. If the golfer can reach a green in regulation, if the golfer takes more than two strokes while putting then the golfer is not playing competitive golf. Professional golfers who are accurate in putting are typically able to use a single putt in order to birdie a hole. Average golfers may take 2 strokes once on the green and below average golfers may take more than 2 strokes which can decimate their game by ineffective putting.

The ability to strike a ball accurately and consistently takes practice, there is no substitute. While the prior art is filled with devices claiming an ability to enhance a golfer's putting ability, practicing on a real grass putting surface is the only way to develop/verify proper putting techniques. For this reason practice greens are found on most every golf course which allow golfers to practice putting on grass that is similar to the putting greens they will experience on the particular golf course. The putting green surface can very from soft or hard, flat or rolling, peculiar grass texture, height and have a growth direction that can change the speed of the ball roll depending on the direction the grass is growing.

While there is no short cut in the amount of time necessary to develop accurate putting, there is a lot of time wasted by a golfer retrieving golf balls while practicing. A practice putting green typically includes a number of golf cups placed on the surface. A ball tray attached to a stick is placed in each golf ball hole to catch practice golf balls. An individual would putt into the hole and remove the practice golf ball by lifting the ball tray so as to eliminate bending. While the use of a ball tray provides eliminates the need for bending over, the use of a ball tray still requires the golfer to approach the hole for manual removal. The stick that is attached to the tray can cause the golfer to learn bad alignment techniques but removal of the tray and stick would require the golfer to bend over to retrieve the practice balls.

A large amount of the time spent in putting practice is consumed during the retrieval of the ball from the cup. The need to approach and retrieve the practice balls is consuming and typically leads to boredom causing the golfer to end the putting practice session with minimal beneficial effect.

Attempts have been made at producing automatic golf ball retrievers, however, such devices are not capable of directional horizontal golf ball displacement if the device is placed within the golf cup. Known automatic golf ball retrievers have many disadvantages due to complexity which leads to early failures. In many instances the retrievers are ejector devices that include sensors and valves not capable of moving the golf ball more than a couple of feet from the golf cup. Such devices employ a vertical motion which operates to project the ball upward out of the cup but fail to provide adequate horizontal movement. If the ball is ejected but remains next to the hole, the golfer still must approach the cup to retrieve the golf ball.

U.S. Pat. No. 1,914,994 discloses a spring loaded golf ball ejector. The ejector is spring loaded wherein the golf ball is raised to the top of the cup, no direction placement of the ball is provided upon ejection.

U.S. Pat. Nos. 3,310,311; 3,310,312; and 3,623,732 disclose a golf ball putting device which automatically ejects golf balls. The device consists of an electromagnet powered by an annular arrangement of rechargeable batteries surrounding a golf ball ejecting armature.

U.S. Pat. No. 3,792,861 discloses a golf cup comprising a hollow body with a ball supporting and ejecting member. An upwardly facing suction cup is mounted within a lower portion of the body and is engageable by a downwardly facing surface portion of the ball ejecting member. Upon initial downward movement of the ball supporting and ejecting member after a golf ball drops in the open upper end of the body and engagement of the downwardly facing surface of the ball ejecting member with the suction cup, the suction cup is operative to retain the ball ejecting member in the lower position for a short period of time until sufficient air is vented through the vent passage between the downwardly facing surface of the ball ejecting member and the suction cup to allow the upwardly biasing action of the compression spring to overcome the retention force of the suction cup and thereby project the ball ejecting member.

U.S. Pat. No. 3,874,665 discloses an apparatus for automating the ejector operation of a golf cup and featuring the use of a flexing diaphragm and/or impacting cup to impart ball impacting force to a golf ball. A telescoping coil and magnet system operate to trigger a control circuit which causes them to interact and impart ball impacting force to the ball and includes means to amplify a signal generated by relative movement induced by the golf ball engaging the diaphragm and moving the diaphragm and coil downwardly. Non-radial ball ejection is effected such that a random ejection pattern results.

U.S. Pat. No. 4,290,603 discloses a ball ejecting golf cup in which a golf ball comes to rest on a vertical spring-biased plunger disposed within the cup to traverse a sealed chamber, the ball and plunger being depressible by the golfer with any suitable tool, and a device for retaining the plunger depressed for a short time, allowing the putter to be removed, and then to release the plunger to snap upwardly to eject the ball upwardly to a height convenient for the golfer to catch it. A mechanism is provided for adjusting both the time delay and also the height to which the ball is ejected.

U.S. Pat. Nos. 4,496,150 and 4,552,358 disclose a golf ball ejection device. A liner will move upwardly to eject a golf ball out of the hole. In one embodiment, the ball is received on a support plate which is sloped so that the ball moves downwardly from the center toward a peripheral wall of the liner. In another embodiment, the liner is provided with a guide way along which the ball travels to a lowermost point in the liner and will then enter on a support plate and move a trigger to cause the support plate to be moved up rapidly to propel the ball outwardly. When a ball is driven into the hole of the liner, it moves down the plate against the trigger mechanism to release the plate and to cause the plate to move upwardly and deposit the ball on the green.

U.S. Pat. No. 5,674,131 discloses a golf ball ejector having an outer cylinder and a movable inner cylinder. A compression spring is disposed beneath the inner cylinder and includes a pair of slots which extend axially along it and a transversely extending pin extends through the slots and is secured to the outer cylinder. The top of the inner cylinder includes a recess for receiving the golf ball. The top of the device also includes recesses for receiving the pin to lock the inner cylinder downwardly relative to the outer cylinder. A golf ball falling onto the top of the inner cylinder causes the inner cylinder to move relative to the pin, and when the pin is out of the recesses the compression spring moves the inner cylinder to eject the golf ball upwardly and out of the cup.

U.S. Pat. No. 5,890,967 discloses a golf ball ejecting apparatus that comprises a sleeve and a main body featuring a solenoid system and surrounded by and attached by sealants to the sleeve. The main body comprises a solenoid-driven plunger, a guide tube, a power source, housing for the power source, phototransistors, solenoid coil, tapered coil springs, a control circuit panel, a flag stick tube, a golf cup and an end plate. The end plate is positioned under the guide tube and serves as a bottom cover for the main body. The solenoid-driven plunger slides in the guide tube which is positioned under the flag stick tube and used for ejecting of a golf ball.

U.S. Pat. No. 6,409,609 discloses a golf ball ejector having a cylindrical side wall, a top opening and a bottom portion with a centered hole. The golf ball ejector comprising a base plate having a top surface for guiding the golf ball onto an ejector plate which is pivotally engaged with the base plate for ejecting the golf ball out of the top opening of the cup when the golf ball is in an ejection position on the ejector plate.

Thus what is lacking in the art is a golf ball ejector that is simplistic in design, can fit into the shortened height of a conventional putting green golf cup, and has the capability of moving a golf ball out of a golf cup in first a vertical direction and then a horizontal direction at a range of upwards to fifteen feet.

SUMMARY OF THE INVENTION

The instant invention is a golf ball ejector device sized to fit within a conventional golf course putting cup as well as a shortened putting cup typically found on practice putting greens. The ejector device employs a spring loaded catapult arm placed into position by a geared drive motor using a timing cam. The device is operated when a ball comes to rest on a staging depression. An actuator operates the drive motor that first releases the spring, biased in a closed position, causing ejection of the golf ball by a quick release of a catapult ejector arm. The cam continues to rotate in a predetermined time rotation which allows a geared resetting of the spring for return of the catapult arm into a ready position. The use of a catapult style ejector arm allows for the movement of the golf ball from a distance from the hole anywhere from two to fifteen feet. Provisions can be made to adjust the spring and/or the length of the catapult arm allowing predetermined or adjustable golf ball placement positions. The distance of the trajectory can by altered by tilting the device, changing the ball holder angle or altering the spring force.

In operation, an individual positions the ejector device within a golf ball cup. When a ball is putted successfully the ball drops onto the device wherein a sloped surface formed along the top of the device causes the golf ball to rest in an actuator zone formed by a depression on the surface having a centrally located motor actuator switch. As the ball comes to rest on the depression, the weight of the golf ball depresses the actuator switch which then activates an electric motor that rotates a cam by use of gears. Once the cam is rotated to a first position a spring loaded catapult arm is released for use in ejecting the golf ball from the golf cup. The cam continues to rotate until the gearing resets the spring catapult arm.

It is an objective of the instant invention to provide a golf ball ejector for use in a conventional golf ball cup or a practice green golf ball cup having a reduced height.

Another objective of the instant invention is to disclose a golf ball ejector having a sloped top surface for facilitating the positioning of a golf ball within an actuator zone.

Still another objective of the instant invention is to use a spring loaded catapult arm that permits horizontal displacement of a golf ball upon return anywhere from two to fifteen feet; and provide a means for adjusting the device to cause a repeatable distance ejection.

Another objective of the invention is to provide directional return of a golf ball to a position determined by the golfer, or allow random placement allowing a variety of golf ball positions.

Another objective of the invention is to provide a remote controller that allows rotation of the device within the cup to allow ejection at a requested position or randomly.

Still another objective of the invention is to provide a remote controller that allows automatic rotation of the device to follow the golfer.

Yet another objective of the instant invention is to provide a compact golf ball ejector device having a release bracket so as to prevent trapping of a golf ball beneath the catapult arm should a golf ball be fall onto the device before the ejector arm is reset.

Still another objective of the instant invention is to provide a compact housing having finger grips that permits alignment, insertion and removal of the device from a golf ball cup.

Yet still another objective of the instant invention is to provide a golf ball ejector that provides a horizontal projection force so as to transfer the golf ball away from the cup along a horizontal path for maximum travel distance.

Yet another objective of the instant invention is to provide a golf ball ejector that may utilize a remote rotation, either a manual input remote or automatic tracking of the player.

Yet still another objective of the instant invention is to teach the use of a timing cam located on the end of a unidirectional motor allowing simplicity in construction and operation.

Another objective of the instant invention is to provide an area upon the upper surface of the device for placement of indicia for use in advertising.

These and other objectives of the invention will become apparent to those skilled in the art upon reading and understanding the following detailed description of the deferred embodiment.

DETAILED DESCRIPTION OF THE PREFERRED EMBODIMENT

Figure 1:
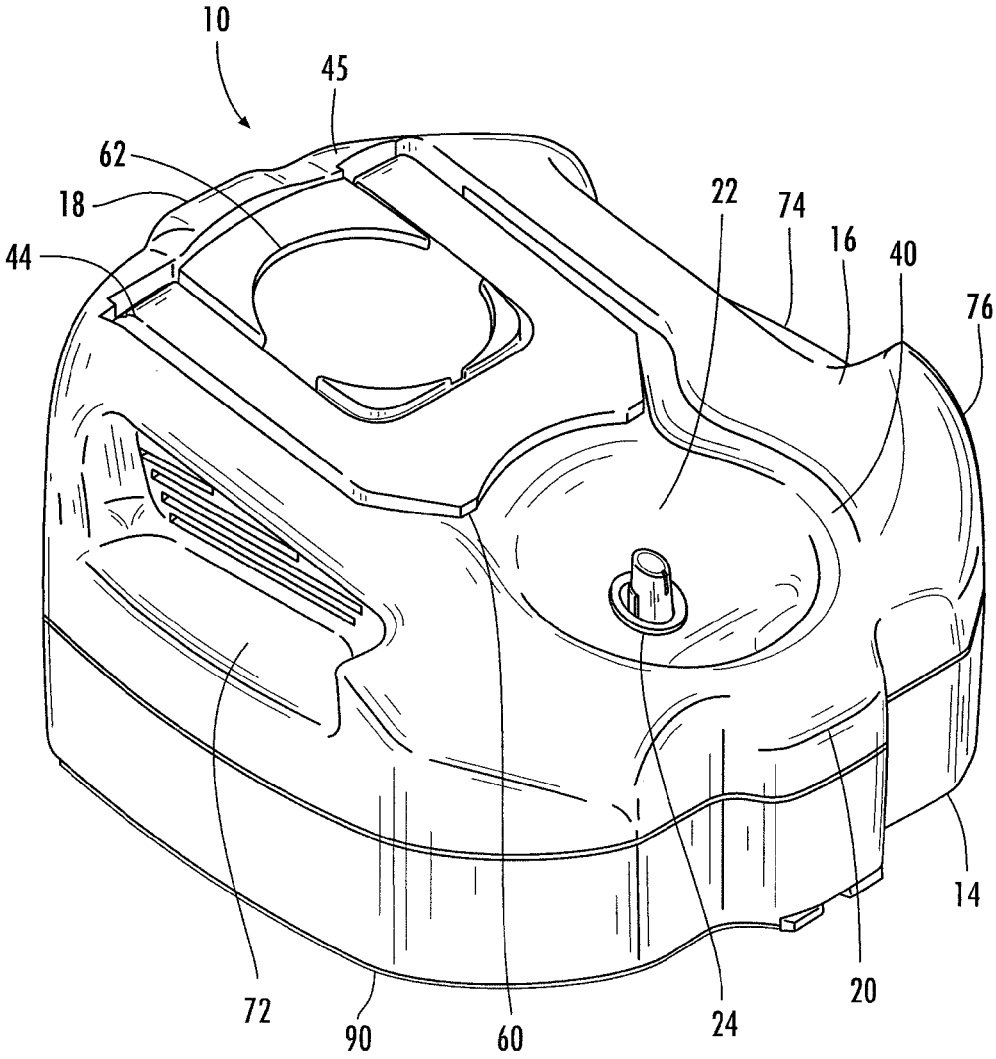
FIG. 1 is a perspective view of the invention.
Figure 2:
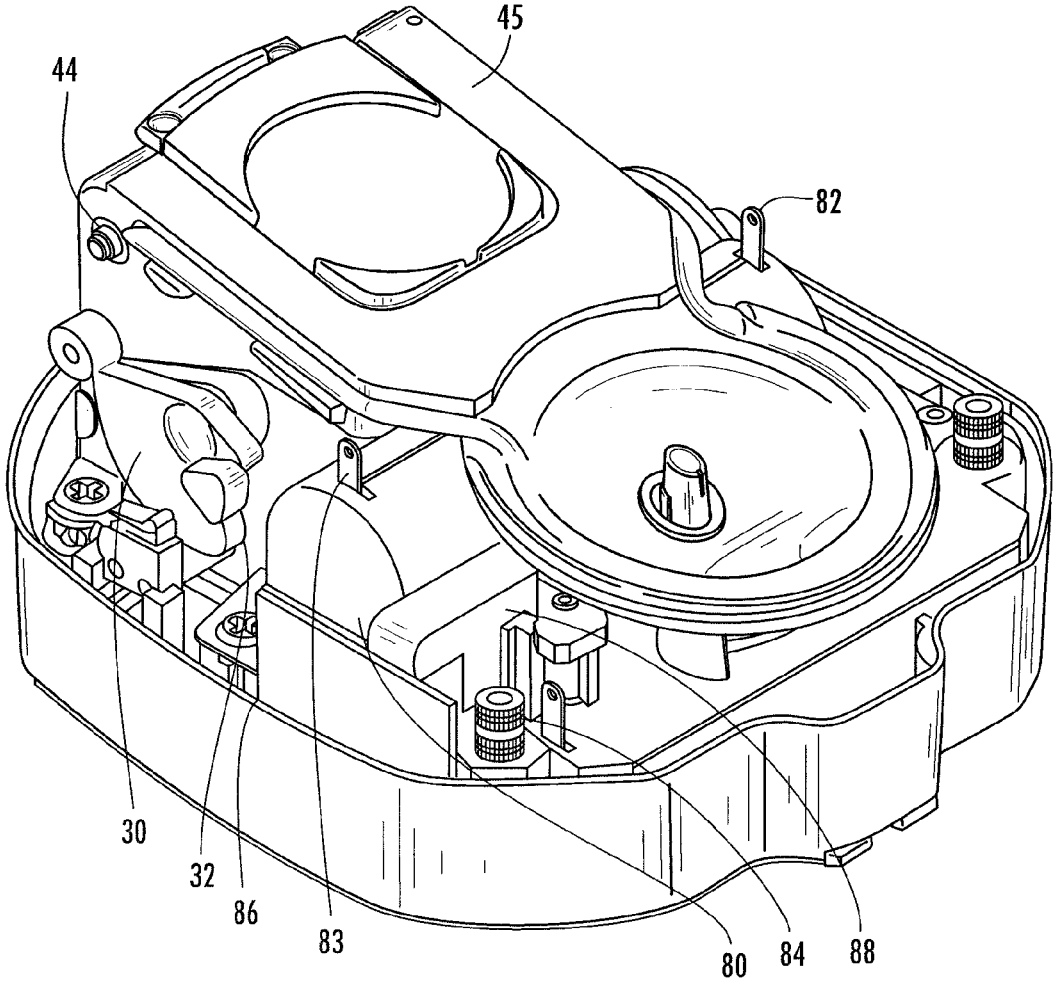
FIG. 2 is a perspective view with the upper cover removed.
Figure 3:
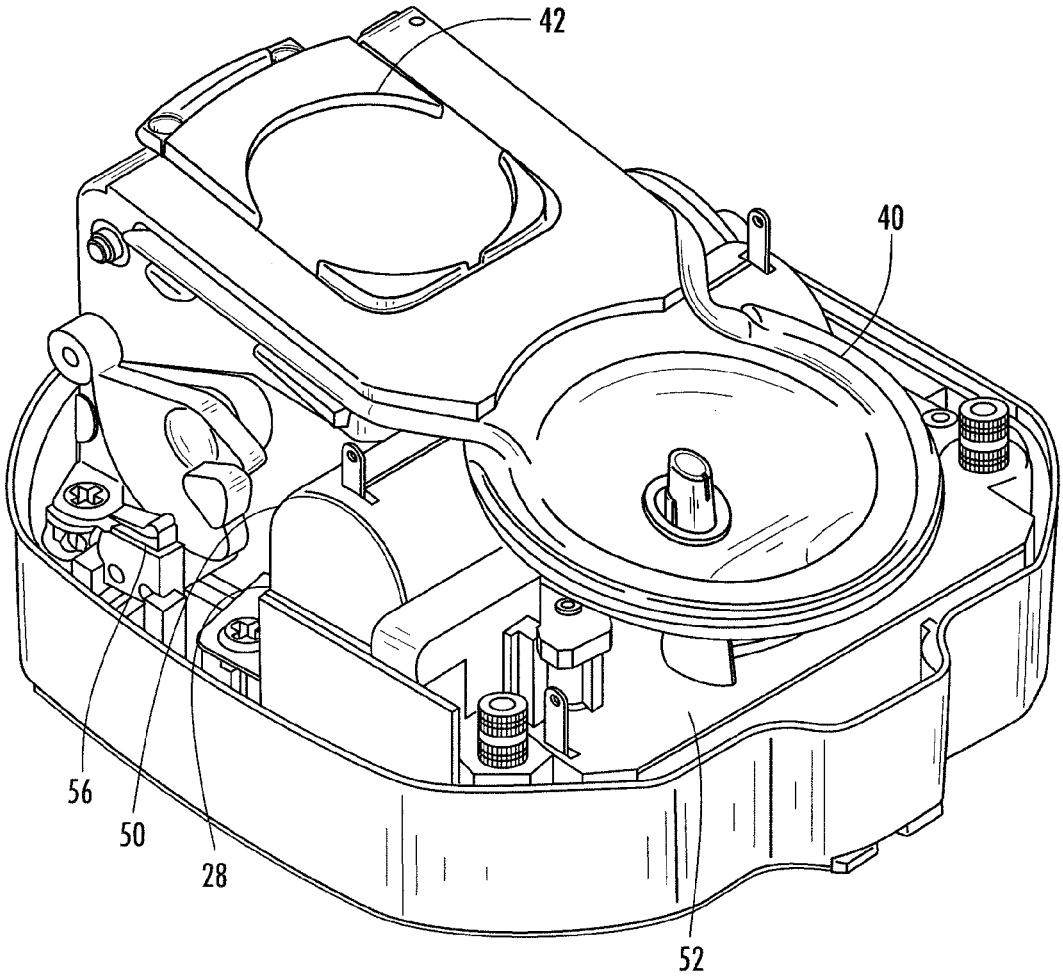
FIG. 3 is a cross-sectional perspective view.
Figure 4:
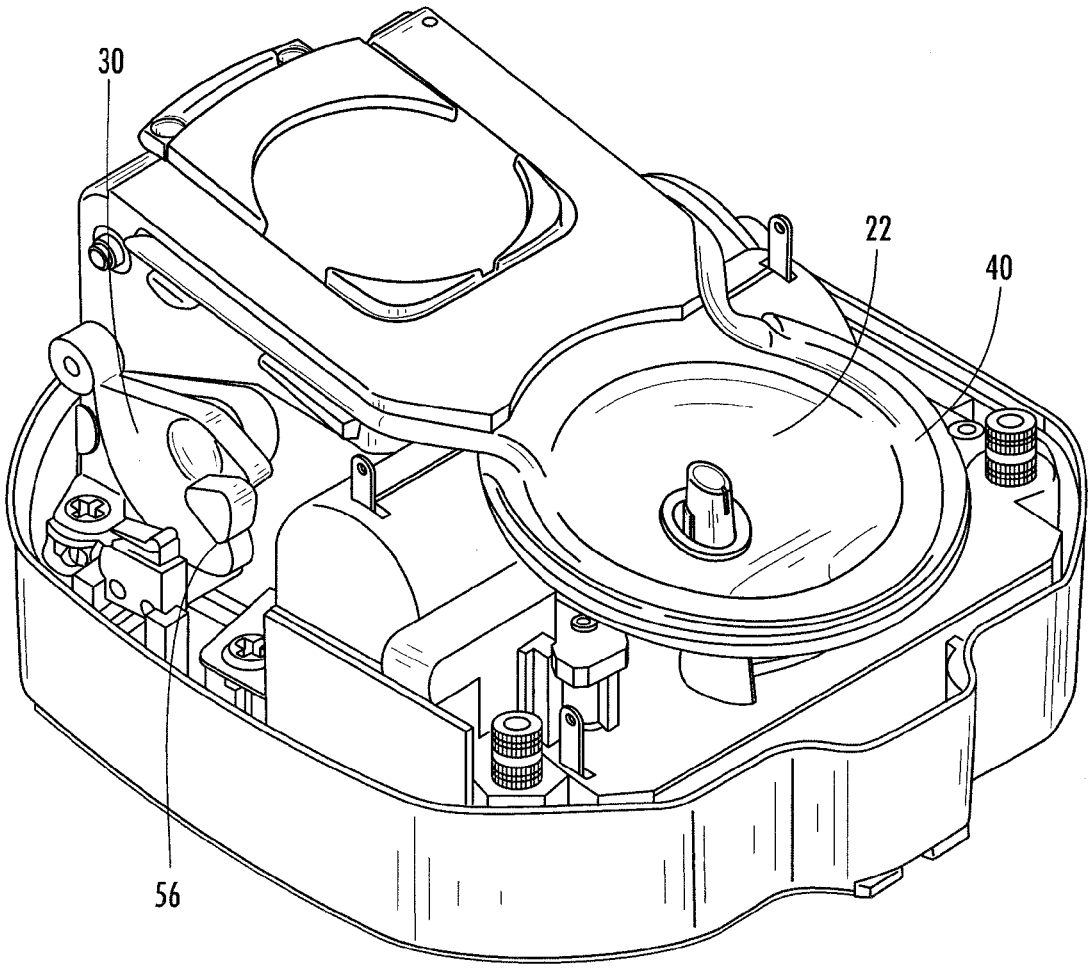
FIG. 4 is a frontal perspective view.
Figure 5:
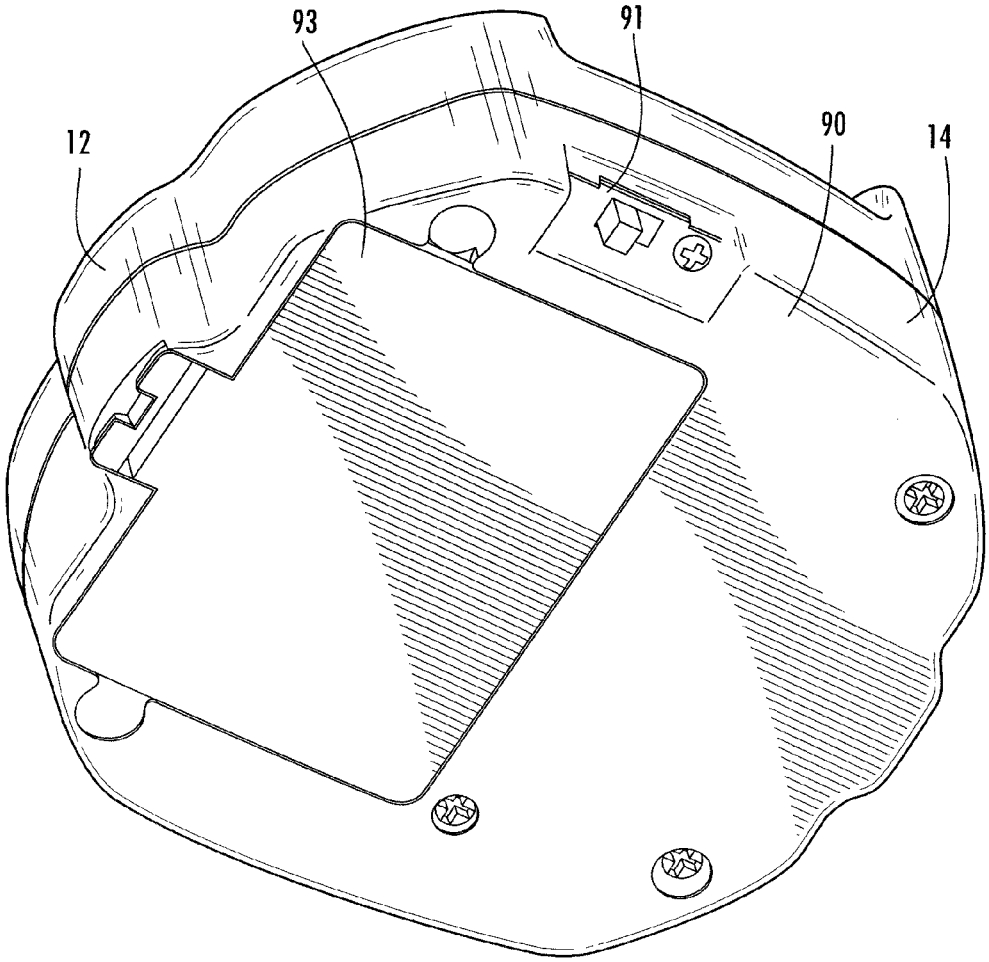
FIG. 5 is a perspective view of the bottom.
Figure 6:
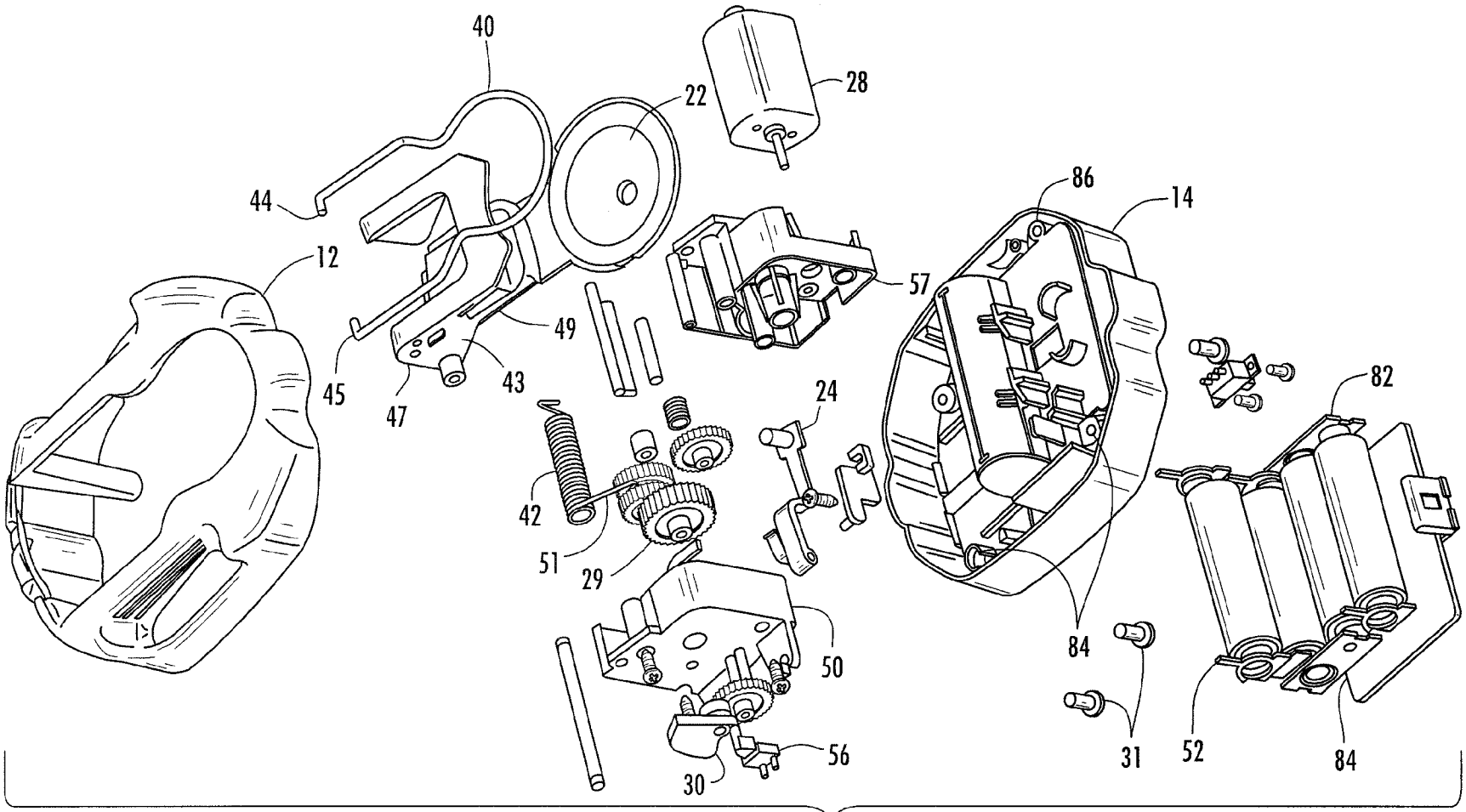
FIG. 6 is an exploded view.

Now referring to Figures, set forth is the golf ball ejector device (10) of the instant invention having a substantially circular shaped housing defined by an upper casing (12) and a lower casing (14). The upper casing has a top surface (16) depicted by an upper edge (18) which has a gradual slope to lower edge (20). The surface is angled to permit directional positioning of a golf ball into an actuation position depicted by the depression (22) configured to receive a portion of a golf ball, not shown. The top surface is sloped at an angle greater than 1 degree so that a golf ball that drops upon the surface is directed to the depression (22). It should be noted that the conventional golf cup is a cylinder with an open top and a closed bottom. The walls of the cylinder cooperate with the sloped surface to funnel the golf ball to the depression. The depression (22) includes a micro switch (24) which is electrically coupled to a drive motor (28) which drives a series of step down gears (29) by use of a timing cam (30).

The timing cam (30) includes an outer surface (32) comprising at least three surfaces for that operate as timing periods, the timing cam is rotated in accordance with drive motor so as to cause operation of a catapult arm (40) biased by a spring (42) that is coiled into position and drives a catapult arm support (43). The catapult arm support (43) is used for mounting the catapult arm (40) along an end portion (47) with arm tabs (49). The spring (42) is released by rotation of the timing cam (30) causing the ejector arm support (43) to operate as a catapult by quick upward operation of the arm support, the ejector arm is lifted upward by the arm tabs and pivots along pivots tips (44 & 45). The ejector arm support (43) can be moved to a sprung position while the ejector arm (40) may absorb the shock of the ball transfer without damage to the arm support (43).

In operation the spring (42) is compressed by rotation of the motor using the gear train (29) to place the catapult support arm from an ejected position to a stored position. The gear train providing the necessary torque for spring reduction. The actuator (24) is placed into a position that can be contacted by a golf ball, namely by placing the actuator through an aperture in the depression (22) area of the top surface, the actuator operating a micro switch for rotation of the motor and timing cam. Once the spring is placed in a ready position by rotation of the gear train, the end (51) of the spring (42) is biased against the catapult support (43) which is released in accordance with the timing action of the cam for ejection of a golf ball.

The gear box (50) steps down the output speed of the motor so that the cam (30) rotates at a predetermined rotation speed and the gear box (50) provides torque and rotating of the spring (42) for positioning in the ready position. A clutch, current overload IC, or a circuit breaker can be used to protect the gears from stripping in the event an object is caught under the throwing arm as it is being reset.

Power is provided by disposable or rechargeable or batteries (52). A low current motor is used to minimize current draw by the use of the gear train to provide the torque necessary for spring compression with minimal battery drain. In the preferred embodiment, four AA batteries provide sufficient current and longevity. A second micro switch (56) is used to disengage the motor (28) once the timing cam rotates to the ready position. The motor is supported to the gear box (56) by use of a matching housing (57) wherein the step down gears (29) are housed for protection from the elements.

The spring (42) may be adjusted so as to cause horizontal projection of a golf ball from two to fifteen feet. The distance of the throw via trajectory can also be made by tilting the device in the cup, changing the ball holder angle, or adjusting spring force. Alternatively the ejector arm may be restricted or even reduced in size so as to minimize horizontal projection.

The ejector arm is recessed into a channel (60) along the top surface (16) providing an uninhibited positioning of a golf ball into the depression (22). The ejector arm (40) is pivotally connected along the upper edge (18) along pivot points (44 and 45) so as to allow stability and directional projection of the golf ball when used in combination with the ejector arm support (47).

The spaced apart pivot points providing stability to the ring shaped ejector arm (40) which is sized to engage a portion of the circumference of the golf ball. The central section (62) of the upper surface is available for placement of indicia for use in advertising and/or marketing of various events should the device be used in tournament or other promotional activities. The upper surface area includes recess (72 and 74) which allows for finger grasping of the device for ease in installation and removal. The outer circumference (76) is sized to allow insertion into a conventional putting green golf cup with minimal interference which provides ability for an individual to cause directional projection of the golf ball ejector as well as allow water drainage should the device be left in while sprinklers or rain enter the golf cup area.

The batteries are placed in a housing (80) having contact points (82 and 83). The bottom half of the casing (14) is coupled to the upper casing (12) by use of fastening screws (31) which are positioned by use of alignment posts (84 and 86). The actuator (24) is an extension of the micro switch (88) which, as previously stated, interconnects DC power from the batteries to the motor for operation of the timing cam (30) and drive train gears. Release of the ejector arm (42) is spring loaded and reset in position by continuous rotation of the timing cam (30) until the second micro switch (56) is engaged to discontinue power to the electric motor.

Upon ejection of a golf ball, the spring can be reloaded into a ready position or the spring can be loaded upon activation of the motor. Should a golf ball be positioned between the bottom of the ejector arm (40) and the golf ball positioning depression (22) there is no torque on the ejector arm that would cause damage to the ejector arm. The cam device provides timing so as to allow for a delayed ejection but will also discontinue operation until the ejector arm (40) is back into the ready position along recess (60). If a golf ball was to be trapped beneath the catapult, no damage would occur to the device as the catapult arm is attached by pivot points that allow and upward movement of the catapult arm. The golf ball ejector device (10) is a substantially cylindrical housing that is sized and arranged to fit within a conventional golf ball cup. The bottom surface (90) is substantially flat and may rest of the curvature of a golf ball cup with a minimal distance between the bottom surface (90) and the upper edge (18) so as to fit within the shortened height of a putting green golf cup. An on/off switch (91) can disable the power source to prevent accidental operation of the device should the actuator be engaged. The device may also be used in a regulation golf cup by propping up the device. In particular the device is sized to be placed upon three golf balls inserted into the golf cup whereon the bottom (90) of the device (10) can then be separated from the bottom at a predetermined height so as to allow the catapult arm (40) to clear the upper edge of the golf cup for proper horizontal projection of a golf ball. The use of three golf balls is unique in that they provide not only a stable platform but also are self leveling.

The actuating switch (22) is preferably placed in the center of the depression which is a circular shaped ball support. The switch is electrically coupled to the batteries and operates the drive motor when depressed. The use of the four AA batteries provides weight for stability. Although other types of power sources can be used such as rechargeable batteries, lithium batteries and the like. The AA batteries are currently the preferred embodiment as they inexpensive to replace and provide weight and stability to the device. The ejector is lightweight due to the simplicity of the plastic parts and needs very little reinforcement as essentially no torque or high stress points are created by the use of a spring loaded catapult arm. The batteries can be easily maintained by access through a removable cover plate (93).

The instant invention fits into any practice or full-depth golf cup. Placement of a few golf balls beneath the device allows proper operation in a full size golf cup. The golf ball ejector device shown and described is used to eject a golf ball in single direction. Alternatively the gear train can include a horizontally disposed rotating gear that can be use to engage the side wall of the cylinder or an edge of the closed end to cause rotation of the device after each golf ball ejection. The rotation of the device results in random rotational positioning of the ball. Still another embodiment is to include either a microprocessor to allow preprogrammed positioning of the ball or the use of a remote controller that allow the golfer to select the direction of the golf placement.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

What I claim is:

1. A golf ball ejector device positionable within a golf cup defined as a cylinder having an open end and a closed end for ejecting a golf ball out of the golf cup in a horizontal direction, said ejector device comprising: a substantially cylindrical housing having an outer surface sized to allow insertion through the top opening of the golf ball cup for placement along the closed end, said housing having a top surface formed from a raised edge that slopes downwardly to a lower edge, a depression strategically positioned along said lower edge for receipt of a golf ball, and a bottom surface; a catapult ejector arm is positioned along said top surface having a first end pivotedly mounted to said raised edge and a second end forming a circular shaped golf ball support; a drive motor operatively associated with said ejector arm; an actuating switch electrically coupled to said drive motor; and a power source connected to said actuating switch to supply power to said drive motor upon depression thereof; whereby said housing is placed within a golf cup for receipt of a golf ball thereon, when a golf ball falls upon the housing the golf ball is funneled to the golf ball support wherein the weight of the golf ball activates the actuating switch for operation of the drive motor to cause the catapult ejector arm to eject the golf ball horizontally from the golf cup.

2. The golf ball ejector device according to claim 1 wherein at least a portion of said outer wall of said housing is edge spaced apart from the cylindrical side wall of the golf cup to allow ease of device removal.

3. The golf ball ejector device according to claim 1 wherein said top surface is sloped at an angle greater than 1 degree between said upper edge and said lower edge for guiding the golf ball onto the depression.

4. The golf ball ejector device according to claim 1 wherein said ejector arm is adjustable to modify the golf ball ejection range between 2 ft and 14 ft.

5. The golf ball ejector device according to claim 1 wherein said housing is sized to allow said ejector arm to extend above the lip of a golf cup during the ejection of the golf ball from a putting green golf cup wherein the golf ball is ejected along a horizontal plane.

6. The golf ball ejector device according to claim 1 wherein said housing is sized to allow said ejector arm to extend above the lip of a golf cup during the ejection of the golf ball from a conventional golf cup wherein said housing is vertically displaced by placing three conventional golf balls between the closed end of the golf cup and the bottom of the housing.

7. The golf ball ejector device according to claim 1 wherein said device may eject a golf ball in single direction.

8. The golf ball ejector device according to claim 1 wherein said device may eject a golf ball in random directions.

9. The golf ball ejector device according to claim 1 wherein the direction said device may eject a golf ball can be remotely controlled.

10. A golf ball ejector device positionable within a golf cup defined as a cylinder having an open end and a closed end for ejecting a golf ball out of the golf cup in a horizontal direction, said ejector device comprising: a substantially cylindrical housing having an outer surface sized to allow insertion through the top opening of the golf ball cup for placement along the closed end, said housing having a top surface formed from a raised edge that slopes downwardly to a lower edge, a depression is strategically positioned along said lower edge for receipt of a golf ball, and a bottom surface; a catapult ejector arm is recessed into said top surface having a first end pivotedly mounted to said raised edge and a second end forming a circular shaped golf ball support recessed into said top surface along a perimeter of said depression; a drive motor operatively associated with said ejector arm, said drive motor having a timing cam causing rotation of said ejector arm along said first end for ejecting of a golf ball positioned in said golf ball support; an actuating switch positioned within said circular shaped ball support and electrically coupled to said drive motor; a power source connected to said actuating switch to supply power to said drive motor upon depression of said actuating switch; whereby said housing is placed within a golf cup for receipt of a golf ball thereon, when a golf ball falls upon the housing the golf ball is funneled to the golf ball support wherein the weight of the golf ball activates the actuating switch for operation of the drive motor to cause the catapult ejector arm to eject the golf ball horizontally from the golf cup.

11. The golf ball ejector device according to claim 10 wherein said drive motor includes a spring operatively associated with said timing cam, said timing cam having a first surface area for maintaining said spring in a compressed position during a first period.

12. The golf ball ejector device according to claim 11 wherein said timing cam includes a second surface area shaped to release said spring from the compressed position for impacting said ejector arm allowing rotation thereof for ejection of the golf ball during a second period.

13. The golf ball ejector device according to claim 12 wherein said timing cam includes a third surface area providing a golf ball reset time delay, wherein said ejector arm has sufficient time to become properly positioned in said depression before ejection.

14. The golf ball ejector device according to claim 10 wherein said top surface includes a recess for receipt of said ejector arm wherein said ejector arm is positionable in said recess while in a stored position.

15. The golf ball ejector device according to claim 10 wherein said ejector arm is adjustable to modify the golf ball ejection range.

16. The golf ball ejector device according to claim 10 wherein said top surface includes a first indentation along and outer peripheral edge of said housing and a second indentation positioned across therefrom providing finger holds for ease of installation and removal of the device.

17. The golf ball ejector device according to claim 10 wherein said housing is sized to allow said ejector arm to extend above the lip of a golf cup during the ejection of the golf ball from a putting green golf cup wherein the golf ball is ejected along a horizontal plane.

18. The golf ball ejector device according to claim 10 wherein said housing is sized to allow said ejector arm to extend above the lip of a golf cup during the ejection of the golf ball from a conventional golf cup wherein said housing is vertically displaced by placing three conventional golf balls between the closed end of the golf cup and the bottom of the housing.

19. The golf ball ejector device according to claim 10 wherein said device may eject a golf ball in single direction.

20. The golf ball ejector device according to claim 10 wherein said device may eject a golf ball in random directions.

* * * * *